United States Patent [19]

Gold et al.

[11] 4,434,259

[45] Feb. 28, 1984

[54] BASE COATINGS FOR USE ON VACUUM METALLIZED PAPER

[75] Inventors: Samuel Gold, Watchung; Arthur A. Tracton, Somerville; Josephine M. Rosenski, North Plainfield, all of N.J.

[73] Assignee: National Starch and Chemical Corporation, Bridgewater, N.J.

[21] Appl. No.: 371,897

[22] Filed: Apr. 26, 1982

[51] Int. Cl.[3] ..... B05D 3/06; G02B 17/00

[52] U.S. Cl. ..... 524/31; 524/32; 524/40; 427/250; 427/326; 427/391; 427/404; 106/195; 428/463

[58] Field of Search ..... 427/250, 404, 391, 326; 106/195; 428/463; 524/31, 32, 40

[56] References Cited

U.S. PATENT DOCUMENTS

| | | | |
|---|---|---|---|
| 2,137,377 | 11/1938 | Bauer et al. | 524/31 |
| 2,150,058 | 3/1939 | Frazier | 524/31 |
| 2,860,110 | 11/1958 | Godshalk | 524/40 |
| 3,677,792 | 7/1972 | Best | 117/35 V |
| 4,177,310 | 12/1979 | Steeves | 428/216 |
| 4,363,851 | 12/1982 | Mishina et al. | 428/333 |

*Primary Examiner*—John Kight, III

*Assistant Examiner*—Nathan M. Nutter

*Attorney, Agent, or Firm*—Margaret B. Kelley; Edwin M. Szala

[57] ABSTRACT

Improved base coatings for use on paper substrates to be vacuum metallized consist essentially of an organic solvent solution (e.g. ethyl acetate or ethyl acetate/toluene) containing about 10–30 wt. % of a film-forming coating mixture of (a) about 90–98 wt. % of a vinyl acetate/acrylic acid copolymer (97.5–99/1–2.5%) or a vinyl acetate/monoethyl maleate copolymer (94–97-/3–6%) and (b) about 2–10 wt. % of a soluble nitrocellulose resin solids, the resin being soluble in the solvent and having a nitrogen content of about 12 wt. % and a viscosity of from about 4–5 sec. in a 25% solution to about 3–4 sec. in a 20% solution of ethyl alcohol/-toluene/ethyl acetate (25/55/20), when measured using the Falling Ball method.

Paper products coated with the base coating (about 2–6 lbs./3000 ft.$^2$) are characterized by a balanced combination of alkali removability, water-resistance, and block-resistance. The metallized products are smooth and glossy, and the aluminized product is especially useful for bottle labels.

10 Claims, No Drawings

BASE COATINGS FOR USE ON VACUUM METALLIZED PAPER

BACKGROUND OF THE INVENTION

This invention relates to improved base coatings for use on paper to be vacuum metallized. It also relates to the resulting improved metallized paper, especially metallized bottle labels, prepared from the base coated paper and the process for their preparation.

As used herein, the term "paper" includes sheet-like masses made from fibrous cellulosic materials which may be derived from both natural sources as well as from synthetics such as polyamides, polyesters, and polyacrylic resins, and from mineral fibers such as asbestos and glass. In addition, papers made from combinations of cellulosic and synthetic materials are applicable herein. Paperboard is also included within the broad term "paper".

Vacuum evaporation or metallization is a process in which an "ultra-thin" layer of metal is deposited on a substrate such as plastic, glass, paper, and the like to achieve a metallic surface appearance. The bright, glossy appearance of metallized papers have lead to their use as decorative wraps and labels. Metallizing directly on paper, however, results in a totally unacceptable material, i.e., a paper with a dull surface. This is due to the rough texture of the paper surface, and even the most highly finished papers have microscopically rough surfaces. Since the deposited metal adheres directly to the surface of the substrate being metallized and also since the resulting metal coating thickness is about 250–300 Angstroms, it isn't surprising that direct metal deposition on paper yields an unacceptable product.

Hence, the paper's surface is typically coated with a base coating which fills minor surface imperfections and provides a smooth surface to receive the metal deposit. Among the properties which are important in base coatings are adhesion, water-resistance, and block-resistance (i.e., resistance to undesired adhesion between touching coated and noncoated surfaces, such as occurs under moderate pressure or sometimes under pressure and heat). While many of the base coatings currently used possess these properties and, in addition, provide the smooth, hard surface needed to give a highly reflective surface when vacuum metallized, the metallized papers may exhibit a high degree of sheet curl and may not be alkali-removable. Excessive sheet curl results in production losses due to feeding problems in high speed bottle labeling or other labeling operations. Poor alkali-removability is a major disadvantage for glass bottle labels since, in the recycling of the bottles, the entire label (metal and base coatings, as well as paper) must be removed during treatment with a dilute, hot alkali solution.

The present invention provides improved base coatings for use on paper to be vacuum metallized. It further provides improved metallized papers, especially aluminized bottle labels, which are characterized by their alkali removability, water-resistance, and block-resistance, as well as their smoothness and gloss.

SUMMARY OF THE INVENTION

The improved lacquer base coatings, useful herein for paper substrates to be vacuum metallized, consist essentially of an organic solvent solution containing about 10–30% by weight of a film-forming coating mixture of (a) about 90–98% by weight of a vinyl acetate/acrylic acid copolymer (97.5–99%/1–2.5%) or a vinyl acetate/monoethyl maleate copolymer (94–97%/3–6%), with the copolymer percentages totaling 100 weight %, and (b) about 2–10% by weight of nitrocellulose resin solids, the resin being soluble in the organic solvent and having a nitrogen content of about 12% by weight and a viscosity of from about 4–5 seconds in a 25% solution to about 3–4 seconds in a 20% solution of ethyl alcohol/toluene/ethyl acetate (25/55/20 parts by weight), when measured using the Falling Ball method.

The base coating is characterized by a balanced combination of desirable properties—namely alkali removability, water-resistance (especially at pH 6–8), and block-resistance, as well as its good flow properties which provide a metallizable surface with good smoothness and gloss. The improvements in the base coating are effected by including these selected carboxyl-containing comonomers in the vinyl acetate copolymer to impart the required balance of alkali removability and water-resistance and by adding the selected nitrocellulose resins to impart the necessary degree of block-resistance.

The improved metallized paper herein is prepared by coating the surface of the paper substrate to be metallized with the base coating, drying the coated paper, and vacuum metallizing (typically aluminizing) the surface of the dried, coated paper substrate. The coating, drying, and vacuum metallizing are carried out using conventional means well-known to those skilled in the art. The coating weight should be sufficient to provide a smooth, continuous base coating. With the more porous papers it may be desirable to precoat the paper substrate prior to application of the base coating herein. The drying conditions should be sufficient to insure substantially complete removal of the solvent.

The metallized papers herein are particularly suited for bottle labels due to their alkali removability and water-resistance. Since the coated paper is water-resistant, the labels will remain on the bottles when they are immersed in tap water (typically about pH 6–8), but will be easily, rapidly, and completely removed during recycling by washing in dilute hot alkaline solutions.

DESCRIPTION OF THE PREFERRED EMBODIMENTS

The vinyl acetate copolymers are present in the coating mixture in amounts of about 90–98% by weight. In preparing suitable vinyl acetate copolymers for use in the base coating composition herein, the practitioner will recognize that there is a delicate balance between alkali removability and water-resistance. Hence, the relative amounts of comonomers in the copolymer are critical to obtaining the desired properties in the final base coating. When the copolymer contains acrylic acid, the comonomer is present in the amount of of about 1.0–2.5%, preferably 1.2–1.8%, by weight in the final copolymer. When the copolymer contains monoethyl maleate as the comonomer, the comonomer is present in the amount of about 3–6%, preferably 3.5–5%, by weight in the final copolymer.

The intrinsic viscosity of the copolymer herein is a factor in determining the film-forming properties of the base coating. Typically, it is in the range of 0.4–0.8 (when measured by efflux viscometer technique). If the intrinsic viscosity is too low, the coated substrate may have poor block-resistance. If the intrinsic viscosity is too high, the viscosity of the base coating may be too high and additional solvent may be required to provide the proper viscosity/coating solids balance. The practitioner will recognize that the viscosity and solids content of the coating may be adjusted depending upon the application method used, so as to provide complete and uniform coverage of the substrate.

The copolymers herein may be readily prepared by a standard solution polymerization in the presence of free radicals using a volatile, inert solvent (e.g. ethyl acetate and/or toluene) which is also suitable as the lacquer solvent. The solution copolymer may then be diluted, if necessary, with additional solvent or with a different solvent or solvent mixture to provide the desired solids content for the coating composition. Suitable solvents include ethyl acetate, butyl acetate, and like acetates; methyl ethyl ketone, methyl isobutyl ketone, di-isobutyl ketone, and like ketones; toluene, xylene, and like hydrocarbons; glycol ethers and glycol ether esters such as glycol ether acetates; and mixtures thereof. Typically, the copolymer solution will be at about 44% solids after the polymerization reaction, and it will be diluted to about 41% solids during the addition of the solvent solution containing the nitrocellulose resin and further diluted to a solids content of about 10–30% by weight, preferably about 18–22%, prior to application.

The second component necessary in the base coating composition herein is the non-blocking additive which is added to prevent sticking of the coated and uncoated surfaces when wound into a roll or stacked. The non-blocking additive is a soluble nitrocellulose resin having a nitrogen content of about 12% (11.8–12.2%) and a viscosity within the range of about 4–5 sec. (25% solution) to about 3–4 sec. (20% solution) in a denatured ethyl alcohol/toluene/ethyl acetate solvent mixture (25/55/20 parts by weight), when measured using the Falling Ball method described in ASTM D-301-72 or ASTM D-1343-74. The additive is present in the coating mixture in amounts of about 2–10%, preferably 4–8%, by weight. The nitrocellulose resins suggested for use herein meet Federal Specifications TT-N-350B.

The actual use of the base coating compositions herein on paper substrates which are to be metallized may be accomplished by any technique capable of depositing a smooth, continuous resin film upon the surface of the paper substrate. The preferred procedures for the deposition of the coating are reverse roll and rotogravure. The coating weight required to form a suitable metallizable base coat may vary depending upon the substrate. It may also depend upon whether the substrate has been precoated and whether or not it is porous. The dry coating should be sufficiently thick to cover substantially all fibrous paper material projecting from the surface. Typically, for a precoated substrate from 2–6 lbs./3000 ft.$^2$ is required, with the optimum being about 2–3 lbs./3000 ft.$^2$, which may deposited in one or more applications.

It may be desirable to precoat the paper substrate prior to the application of the base coating herein. This may reduce the amount of base coating composition required and it can prevent excessive penetration of the base coating into the body of an excessively porous substrate. In addition, the precoat may tend to provide a smoother surface, which will not influence the balance of the desired properties, but will affect the gloss of the metallized coating (the smoother the surface, the better the gloss). Among the applicable materials which may be used for a precoat are starch, alginates, polyvinyl alcohol, polyvinyl acetate latex, and the like. These materials may be used alone or in combination with pigments such as clay, calcium carbonate, and titanium dioxide. The precoat may be applied by means of any conventional coating apparatus, as well as by size press and from water boxes of a calender stack.

Suitable paper substrates for use herein include both heavy and thin paper stocks, for example, bleached and unbleached sulfate (kraft), bleached and unbleached sulfite, bleached and unbleached soda, neutral sulfite, semi-chemical and chemical groundwood, groundwood, and the like. The preferred substrates for metallized bottle labels include those with a clay coating, wet rub resistance, or wet strength.

The actual metallization of the base coated paper substrates may be accomplished, after the coating composition has been dried, by any conventional means. Preferably, the coated substrate is hot air dried for about 0.5–3 minutes at about 93°–121° C. (200°–250° F.). It may be air dried at room temperature for an extended period of time. The drying time will vary depending upon the thickness of the base coating and the solvent used. It is important to remove residual solvent otherwise problems such as picking may develop.

The dried, coated paper substrate is then vacuum metallized. Vacuum metallization is well-known and the detailed procedures will be apparent to those skilled in the art. A review of vapor deposition techniques may be found in *Vapor Deposition,* C. F. Powell, J. H. Oxley, and J. M. Blocker, Jr., eds., John Wiley & Sons, Inc., New York (1966). Typically the coated paper substrate is unwound, exposed to the metallizing source under high vacuum, and rewound. The optimum vacuum level will depend upon the coating material and most often is $10^{-4}$ Torr. or less. The particular metal chosen will vary with the requirements of the practitioner. Suitable metals include zinc, cadmium, copper, silver, gold, and for bottle labels preferably aluminum. Evaporation sources which can be used in single or multiple chambers include an oven with indirectly heated crucibles, an intermetallic boat heated by direct current, inductive evaporation, electron beam evaporation, and sputtering.

In the following examples, which will more fully illustrate the embodiments of this invention, all parts and percentages are given by weight and all temperatures are in degrees Celsius unless otherwise noted. The following testing procedures were used in the laboratory for a preliminary evaluation of the base coatings. Actual tests on metallized substrates under the conditions of usage provide the most definitive evaluation of suitable base coatings.

Blocking Resistance

This test determines the resistance to blocking of any two surfaces. The dried, coated paper substrate is cut to fit aluminum plates (1×1 7/64×1/16 in.) and placed face to back between two aluminum plates. The assembled specimen is placed on a glass plate, weighted with a 2000 g. weight on the top (4 lbs./in.$^2$), and heated in an oven at about 60° C. (140° F.) for 16 hrs. After removal from the oven, the weight is removed and the assembled specimen is allowed to cool to room temperature before being slowly peeled apart to check for blocking (i.e. sticking). The block-resistance is rated on a scale from 0–10, with highest value indicating excellent block-resistance. The values are determined and rated as follows:

10—Panels fall apart.
8—Papers pull apart with very little effort; surface is unmarred.
6—Papers pull apart with some effort; surface is unmarred.
4—Papers pull apart with some effort; surface is mottled.
2—Papers pull apart with effort; surface is marred and up to 20% can not be separated.
0—Papers can not be pulled apart.

Alkali Penetration Test

This test, which determines the amount of alkaline solution that penetrates the base coating, is used to approximate alkali removability. Dried, coated paper samples (4×4 in.) are taped to glass plates. Using an eye dropper, 5 drops of hot 5% sodium hydroxide solution (60° C.) are placed in 3 spots on each paper sample. The samples are allowed to stand for 1 and 5 min., respectively, blotted dry, and visually evaluated after turning the glass plates over. The penetration is rated as a percentage of the surface wetness (i.e., average wet area of 3 spots). The greater the penetration, the lower the hot alkali-resistance and hence the better the alkali removability. The % penetration and corresponding ratings are as follows:

| % Penetration | Rating |
|---|---|
| 100% - completely wetted | perfect |
| 80% | excellent |
| 60% | good |
| 40% | fair |
| 20% | poor |
| 0% - completely dry | failed |

Water/pH Penetration Test

This test, which determines the effect on the base coating of water at different pH values, is used to approximate the water-resistance of the base coating. The test is carried out in the same manner as the akali penetration test except that water at room temperature, instead of hot alkali solution, is dropped on the dried, coated paper sample which is allowed to stand for 1 hr. before the surface is blotted dry and the visual examination is carried out. A series of individually identified spots are formed using tap water (about pH 6–6.5) and buffered solutions at pH 7 and 8 (Ace Scientific Supply Co.). The penetration is rated as a percentage of surface wetness (average wet area of 3 spots). The less the penetration, the better the water-resistance at the indicated pH. The % penetration and corresponding ratings are as follows:

| % Penetration | Rating |
|---|---|
| 0% | perfect |
| 20% | excellent |
| 40% | good |
| 60% | fair |
| 80% | poor |
| 100% | failed |

Adhesion Test

This test, which determines the bonding of a coating to its substrate, is used to evaluate the bonding of the base coating to an uncoated or precoated paper substrate. A ½ in. piece of Scotch tape (#810) is laid down on the coated, dried paper substrate along the machine direction of the coating leaving one end free. Using even pressure of the thumb, the tape is rubbed 5 times in the machine direction; the loose end of the tape is then grabbed and the tape is snapped off. The adhesion ratings are as follows:

10—Good adhesion—tapes are clean; coating is undisturbed.
0—Poor adhesion—tapes show coating; coating from entire tape-covered area is removed.

Paper Surface Smoothness Test

This test, which measures the air flow through the substrate, is used to evaluate the porosity of the dried, coated paper substrate. A Sheffield Tester (Bendix Co.) is used. The test, is described in "Pulp and Paper" by James P. Casey, Vol. III, p. 1290–91, Interscience Publishers, New York 1961. On the Sheffield scale the units range from 0–400, with 0 representing perfect smoothness and with values of 40 or less being considered satisfactory herein.

EXAMPLE I

This example illustrates the use of a lacquer containing a vinyl acetate/acrylic acid copolymer and nitrocellulose as the base coating for a clay coated paper substrate.

A vinyl acetate/acrylic acid copolymer (98.8/1.2 wt. %) was prepared by adding an initial charge of 33 parts ethyl acetate, 16 parts vinyl acetate, and 0.16 part initiator to a 2 liter round bottom flask fitted with a condenser, stirrer, thermometer, and addition funnels. Agitation was begun and the mixture was heated to reflux (71° C.). At reflux a monomer mixture of 84 parts vinyl acetate and 1.25 parts acrylic acid was slowly and uniformly added over 2 hr. Additional initiator (0.14 part in 22 parts ethyl acetate) was slowly and uniformly added over 1.25 hr. starting 1 hr. after reflux. At 3 hr. after reflux, 17 parts ethyl acetate was added over 0.5 hr. to control the viscosity. Refluxing was continued for a total of 8 hr. from the start of reflux. Heating was then discontinued, 60 parts ethyl acetate were added during the cooling, and agitation was continued for 1 hr. to insure uniform solution. The resulting copolymer had an intrinsic viscosity of 0.78.

The resulting copolymer solution had a solids content of 43 wt. % (theoretical 43.48%) and a Brookfield viscosity of 9950 cps. It was mixed with an ethyl acetate solution containing nitrocellulose resin sold under the trademark RS ½ sec by Hercules Chemical Corp. having a Brookfield viscosity of 10,640 cps. The resulting lacquer (about 41 wt. % solids) contained 4 wt. % nitrocellulose resin solids.

Using a wire wound rod, a thin wet film of the lacquer was applied to one side of a sheet of clay-coated groundwood paper having a basis weight of 50 lbs./3000 ft.$^2$ sold under the trademark Label Coat by St. Regis Paper Co. The base coating was hot air dried for 1 min. at 121° C. (250° F.). The dry base coating weight was 3 lbs./3000 ft.$^2$.

The base coated paper was evaluated using the testing methods described hereinabove. The base coating showed good adhesion, good block-resistance (7), and very good Sheffield smoothness (25). The water-resistance was good (10% penetration at pH 6–6.5, 30% at pH 7, and 60% at pH 8). The hot alkali penetration (10% and 60% after 1 and 5 min.) indicated rapid and complete alkali removability of the metallized label can be expected. The initial laboratory results were confirmed with an aluminized coating, as reported in Example VI.

EXAMPLE II

This example studies the effect of varying the amount of acrylic acid in the vinyl acetate copolymer. The polymerization, lacquer preparation, substrate (non-metallized), application conditions, and evaluation procedures were the same as in Example I. The results are given in Table I, which also contains comparative data on the substrate coated with the lacquer of Example I.

TABLE I

| Test | Acrylic Acid (wt. %) in Vinyl Acetate in Copolymer | | | |
|---|---|---|---|---|
| | Control (0%) | 1.2%[a] | 1.75% | 2.5% |
| Water Penetration (% after 1 hr. at) | | | | |
| pH 6–6.5 | 0 | 10 | 0 | 5 |
| pH 7 | 0 | 30 | 10 | 20 |
| pH 8 | 0 | 60 | 100 | 100 |
| Alkali Penetration (% at) | | | | |
| 1 min. | 0 | 10 | 30 | 30 |
| 5 min. | 0 | 60 | 40 | 40 |
| Sheffield Smoothness | [b] | 25 | [b] | 35 |

[a] Lacquer of Example I
[b] Not measured

The results show that increasing the amount of acrylic acid beyond 1.2 wt. % affected the water-resistance at pH 8. The control containing no acrylic acid was water-resistant, but it was not alkali removable.

EXAMPLE III

This example demonstrates the use of other carboxyl-containing comonomers in the vinyl acetate copolymers. The polymerization, lacquer preparation, substrate (non-metallized), application conditions, and evaluation procedures were the same as in Example I. The results are given in Table II which also contains comparative data on the substrate coated with the lacquer of Example I.

TABLE II

| Test | Comonomer (wt. %) in Vinyl Acetate Copolymer | | | | |
|---|---|---|---|---|---|
| | Maleic[a] Acid | | Monoethyl Maleate | | Acrylic[b] Acid |
| | (1.7%) | (2.0%) | (3.5%) | (5.0%) | (1.25%) |
| Water Penetration (% after 1 hr. at) | | | | | |
| pH 6–6.5 | 0 | 0 | 0 | 0 | 10 |
| 7 | 0 | 0 | 50 | 100 | 30 |
| 8 | 0 | 5 | 100 | 100 | 60 |
| Alkali Penetration (% after) | | | | | |
| 1 min. | 5 | 5 | 0 | 80 | 10 |
| 5 min. | 5 | 5 | 20 | 100 | 60 |
| Sheffield Smoothness | 10 | 20 | [c] | [c] | 25 |

[a] Comparative
[b] Lacquer of Example I
[c] Not determined

The results show that not all carboxyl-containing comonomers provide copolymers with the required properties—namely alkali removability, water-resistance, and block-resistance.

Substrates coated with lacquers containing the maleic acid copolymer showed satisfactory smoothness but did not show the alkali removability required herein. Surprisingly, increasing the maleic acid level in the copolymer did not improve the alkali removability.

Substrates coated with lacquers containing the monoethyl maleate copolymers showed satisfactory smoothness. The comonomer containing 5 wt. % showed better alkali removability than the comparative lacquer of Example I but its water-resistance at pH 7–8, based on the laboratory evaluation of the non-metallized substrate, was poor. However, in actual use with an aluminized coating it showed good water-resistance (see Example VI). Decreasing the comonomer amount to 3.5 wt. % somewhat improved the water-resistance; however, it reduced the alkali removability.

It is thus shown that, in addition to the acrylic acid comonomer, monoethyl maleate comonomer, was satisfactory, whereas the maleic acid comonomer was unsatisfactory.

EXAMPLE IV

This example studies the effect of varying the amount of nitrocellulose anti-blocking agent. Nitrocellulose resins (about 12% N) sold under the trademarks RS ¼ sec and RS ½ sec by Hercules Chemical Co. were used at 4 and 8 wt. % of solids. A control containing no nitrocellulose was evaluated. The lacquer contained the vinyl acetate/acrylic acid (98.8/1.2 wt. % ) copolymer of Example I. The lacquer preparation, substrate (non-metallized), application conditions and the evaluation procedures were the same as in Example I. Data on the evaluation of the lacquers as base coatings is summarized in Table III.

TABLE III

| Test | Nitrocellulose Resin (wt. %) | | | | |
|---|---|---|---|---|---|
| | Control | RS ¼ sec | | RS ½ sec | |
| | (0%) | (4%) | (8%) | (4%) | (8%) |
| Block Resistance | 4 | 6 | 8 | 7 | 8 |
| Water Penetration (% after 1 hr. at) | | | | | |
| pH 6–6.5 | 50 | 10 | 5 | 0 | 5 |
| pH 7 | 100 | 20 | 30 | 5 | 30 |
| pH 8 | 70 | 20 | 10 | 10 | 10 |
| Alkali Penetration (% at) | | | | | |
| 1 min. | 30 | 10 | 20 | 20 | 20 |
| 5 min. | 30 | 10 | 20 | 60 | 50 |
| Adhesion | 10 | 10 | 10 | 10 | 10 |
| Sheffield Smoothness | 25 | 25 | 30 | 23 | 28 |

The results show that the addition of the nitrocellulose resins improved the block-resistance, did not affect the adhesion, and did not adversely affect the smoothness. The RS ½ sec resin provided a good balance of properties. The less viscous, lower molecular weight RS ¼ sec resin showed good water resistance at pH 6–8 but did not show good alkali removability in the laboratory evaluation on the non-metallized substrate. However, in actual use with an aluminized coating this resin was satisfactorily removed (see Example VI).

EXAMPLE V

This example demonstrates that only the selected nitrocellulose resins provide the required balance of properties. The following hardening resins were evaluated at 4 and 8 wt. % solids:

A vinyl chloride/vinyl acetate/maleic acid polymer (83/16/1 wt.%) having a Tg of 72° C. and avg. mol. wt. of 15,000 sold under the trademark UCAR Solution Vinyl VMCC Resin by Union Carbide at 25 wt. % solids in methyl ethyl ketone/toluene (50/50) which has a viscosity of 250 cps. at 25° C.

A vinyl chloride/vinyl acetate polymer (90/4 wt. %) which also contains a hydroxyl-containing comonomer (2.3 wt. % OH) having a Tg of 79° C. and avg. mol. wt. of 23,000 sold under the trademark UCAR Solution Vinyl VAGH Resin by Union Carbide at 25 wt. % solids in methyl ethyl ketone/-toluene (50/50) which has a viscosity of 350 cps. at 25° C.

A soluble methyl methacrylate polymer at 40% solids in toluene/methyl Cellosolve sold under the trademark Acryloid B-44 by Rohm & Haas. Cellosolve is a solvent sold under that trademark by Union Carbide.

A resin having a viscosity of 0.2 sec.-0.76 cps. (ASTM D817, Formula A, and D1343), acetyl and butyrl contents of 2% and 52% (ASTM D817), hydroxy content of 1.8%, equivalent weight of 945, and Tg of 101° C. sold under the trademark Cellulose Acetate Butyrate CAB 551-0.2 by Eastman.

A resin having a viscosity of 3 sec.-11.4 cps. (ASTM methods given above), acetyl content of 39.8%, combined acetic acid of 55.5% (ASTM D871), hydroxy content of 3.5%, and Tg of 180° C. sold under the trademark Cellulose Acetate CA-398-3 by Eastman.

A pale thermoplastic resin soluble in typical organic solvents which has a softening point of about 131° C. and an acid number of about 140 sold under the registered trademark Pentalyn 856 Synthetic Resin by Hercules.

An exceptional pale, rosin-derived thermoplastic resin soluble in typical organic solvents which has a softening point of about 166° C. and an acid number of about 205 sold under the registered trademark Pentalyn 261 Synthetic Resin by Hercules.

The lacquer preparation, substrate (non-metallized), application conditions, and evaluation procedures were as in Example I. Ethyl acetate was used as the solvent except where noted. The copolymer was the vinyl acetate/acrylic acid copolymer (98.8/1.2 wt. %). Data on the evaluation of the base coated substrates is given in Table IV.

The results show that none of the resins, which included vinyl, acrylic, and cellulose esters, provided the required balance of properties. Only three of the resins (VMCC at 4 & 8 wt. %, CAB 551 at 4 wt. %, and CA 398 at 4 wt. %) showed adequate block-resistance, but they all were lacking in alkali removability. Several resins (VAGH and Pentalyn 261 and 856) showed good alkali removability, but their block-resistance was poor. Increasing the amount added from 4 to 8 wt. % did not improve their block-resistance to a satisfactory level. The addition of Pentalyn 865 at 8 weight % caused the lacquer to gel.

TABLE IV

| | Hardening Resin (wt. %) | | | | | | | | |
|---|---|---|---|---|---|---|---|---|---|
| | VMCC | | VAGH* | B 44 | CAB 551 | CA 398 | | Pentalyn 261 | Pentalyn 856 |
| Test | (4%) | (8%) | (4%) | (4%) | (4%) | (4%) | (8%) | (4%) | (4%) |
| Block Resistance | 7 | 6 | 2 | 4 | 6 | 6 | 4 | 4 | 2 |
| Water Penetration (% after 1 hr. at) | | | | | | | | | |
| pH 6-6.5 | 10 | 10 | 5 | 10 | 30 | 30 | 100 | 10 | 0 |
| 7 | 100 | 30 | 10 | 30 | 30 | 30 | 0 | 20 | 60 |
| 8 | 80 | 10 | 5 | 5 | 10 | 20 | 10 | 20 | 40 |
| Alkali Penetration (% after) | | | | | | | | | |
| 1 min. | 10 | 0 | 20 | 5 | 0 | 5 | 5 | 10 | 30 |
| 5 min. | 20 | 10 | 50 | 10 | 0 | 20 | 30 | 50 | 70 |

*Solvent is ethyl acetate/toluene (1/1).

EXAMPLE VI

This example demonstrates the performance of the base coatings herein on commercially prepared aluminized bottle labels under actual usage conditions.

The following lacquers were evaluated: Lacquer A (20% total coating solids )—96 wt. % vinyl acetate/acrylic acid copolymer (98.8/1.2 wt. %) and 4 wt. % RS ¼ sec nitrocellulose resin in ethyl acetate.

Lacquer B (20% total coating solids)—96 wt. % vinyl acetate/monoethyl maleate copolymer (95/5 wt. %) and 4 wt. % RS ¼ sec nitrocellulose resin in ethyl acetate.

Lacquer C—same as Lacquer B except that the solvent was a 1:1 mixture of ethyl acetate/toluene.

Paper substrates (wet rub resistant) were coated with the above lacquers and dried. The coated substrates gave 60° geometry specular gloss readings in excess of 80 (ASTM D 523-80 testing procedure). The metallized labels had good gloss and good block-resistance. Their water-resistance was also good—when stored in tap water for up to 24 hours, the labels showed good adhesion. During washing in a typical bottle washer with dilute hot alkali (about pH 12 and 60° C.), the adhered labels were easily and completely removed by the 3rd stage of a 6–7 stage unit, and there was no gummy residue on the inside or outside of the bottle or on the removed label.

Summarizing, this invention provides an improved base coating for use on paper substrates to be vacuum metallized and improved metallized paper products, especially aluminized bottle labels, characterized by their alkali removability, water-resistance, and block-resistance.

Now that the preferred embodiments of the present invention have been described in detail, various modifications and improvements thereon will become readily apparent to those skilled in the art. Accordingly, the spirit and scope of the invention are to be limited only by the appended claims and not by the foregoing specification.

What is claimed is:

1. A lacquer base coating for paper substrates to be vacuum metallized, which consists essentially of a volatile organic solvent containing about 10–30% by weight of a film-forming coating mixture of:

(a) about 90–98% by weight of a copolymer of 97.5–99% vinyl acetate and 1–2.5% acrylic acid or a copolymer of 94–97% vinyl acetate and 3–6% monoethyl maleate, with the copolymer percentages totaling 100% by weight; and (b) about 2–10% by weight of nitrocellulose resin solids, said resin being soluble in said solvent and having a nitrogen content of about 12% by weight and a viscosity of from about 4–5 seconds in a 25% solution to about 3–4 seconds in a 20% solution of ethyl alcohol/toluene/ethyl acetate (25/55/20 parts by weight), when measured using the Falling Ball method;

said coated substrate characterized by a balanced combination of alkali removability, water-resistance, and block-resistance.

2. The lacquer of claim 1, wherein the film-forming coating mixture is present in an amount of about 18–22% and is a mixture of (a) 92–96% of the copolymer of 98.2–98.8% vinyl acetate and 1.2–1.8% acrylic acid and (b) 4–8% of the nitrocellulose resin.

3. The lacquer of claim 1, wherein the film-forming coating mixture is present in an amount of about 18–22% and is a mixture of (a) 92–96% of the copolymer of 95–96.5% vinyl acetate and 3.5–5% monoethyl maleate and (b) 4–8% of the nitrocelulose resin.

4. The lacquer of claim 2, wherein the organic solvent is ethyl acetate and the film-forming coating mixture is present in an amount of 20% and is a mixture of (a) 96% of the copolymer of 98.8% vinyl acetate and 1.2% acrylic acid and (b) 4% of the nitrocellulose resin having the 4–5 second viscosity in the 25% solution.

5. The lacquer of claim 3, wherein the organic solvent is ethyl acetate or ethyl acetate/toluene and the film-forming coating mixture is present in an amount of 20% and is a mixture of (a) 96% of the copolymer of 95% vinyl acetate and 5% monoethyl maleate and (b) 4% of the nitrocellulose resin having the 4–5 second viscosity in the 25% solution.

6. In a process for the vacuum metallization of a paper substrate, wherein the paper substrate is passed into a high-vacuum metallization chamber in which a metallic vapor is deposited upon the paper substrate, the steps of:

(a) first applying, to a surface of the paper substrate to be metallized, a coating of the lacquer of claim 1 in an amount sufficient to form a continuous, smooth film of said copolymer and said resin sufficient to cover substantially all fibrous paper material projecting from said surface;

(b) drying said coated paper substrate to substantially remove said solvent; and (c) metallizing the surface of said dried, coated paper substrate.

7. In the process of claim 6, wherein said lacquer application is carried out in one or more applications to a total dry coating weight about 2–6 lbs./3000 ft.$^2$.

8. In a process of claim 6, wherein said drying is carried in a hot air dryer for about 0.5–3 minutes at about 93°–121° C. (200°–250° F.).

9. A metallized paper product, which comprises a paper substrate coated on at least one side thereof with a smooth, continuous coating of the lacquer of claim 1, dried, and overcoated with a thin metallic layer applied by vacuum metallization.

10. The metallized paper product of claim 9, wherein said metallic layer is aluminum; wherein said lacquer consists essentially of the ethyl acetate or ethyl acetate/toluene solution containing about 18–22% by weight of the coating mixture of (a) about 96% of a copolymer of 98.2–98.8% vinyl acetate and 1.2–1.8% acrylic acid or a copolymer of 95.0–96.5% vinyl acetate and 3.5–5% monoethyl maleate and (b) about 4% by weight of the nitrocellulose resin having the 4–5 second viscosity in the 25% solution; wherein said coating weight is about 2–3 lbs./3000 ft.$^2$; and wherein said paper substrate is clay coated, has wet rub resistance, or has wet strength; said aluminized paper product being especially useful as bottle labels.

* * * * *